United States Patent [19]

Matsumoto

[11] Patent Number: 4,897,696

[45] Date of Patent: Jan. 30, 1990

[54] METHOD OF DETECTING ABNORMALITY IN HEAT ROLLER

[75] Inventor: Manabu Matsumoto, Nara, Japan

[73] Assignee: Sharp Kabushiki Kaisha, Osaka, Japan

[21] Appl. No.: 248,425

[22] Filed: Sep. 23, 1988

[30] Foreign Application Priority Data

Oct. 7, 1987 [JP] Japan ..... 62-253055

[51] Int. Cl.[4] ..... G23N 15/00

[52] U.S. Cl. ..... 355/285; 207/117; 219/216

[58] Field of Search ..... 361/103; 355/14 F, 282, 355/285; 219/216; 207/117

[56] References Cited

U.S. PATENT DOCUMENTS 4,104,692 8/1972 Sudo et al. ..... 361/106
4,232,959 11/1980 Ateya et al. ..... 355/14 FU
4,415,800 11/1983 Dodge et al. ..... 219/216 X

*Primary Examiner*—Derek S. Jennings
*Attorney, Agent, or Firm*—Flehr, Hohbach, Test, Albritton & Herbert

[57] ABSTRACT

An abnormality in a rotatable heat roller is detected by measuring its temperature at a specified time after the heating of the roller is started. This specified time is not fixed but is variably set according to the length of time during which the roller is rotated.

3 Claims, 2 Drawing Sheets

METHOD OF DETECTING ABNORMALITY IN HEAT ROLLER

BACKGROUND OF THE INVENTION

This invention relates to a method of detecting an abnormal condition in a heat roller and more particularly to a method of detecting an abnormal temperature condition in a rotatable heat roller, for example, of an electrophotographic copier after a specified length of time has passed since the heating of the heat roller was started.

One of the methods of detecting an abnormal temperature condition in the heat roller of an apparatus such as an electrophotographic copier while the apparatus is warming up is to calculate on the basis of a rate of temperature rise the time required for the heater to reach a preset temperature level after its heating is started and then to determine whether this calculated time is within a preset reference time length or not. Another method is to compare the heater temperature measured after a preset period of time with a preset reference temperature. By the first method, the heater is considered to be in an abnormal condition and its power supply is shut off if the calculated time exceeds the preset reference time length. By the second method, an abnormal condition is considered to exist if the measured temperature is higher than the preset reference temperature.

While an apparatus such as an electrophotographic copier is being warmed up, however, not only is its heater preheated but also the driving system for the entire apparatus is operated, for example, to control the toner concentration for the developer unit. When the driving system begins to operate, the heat roller begins to rotate and the rate of temperature increase of the heater is lower when the roller is rotated than when it is stationary. Thus, a correct time required for the heater to reach a preset reference temperature cannot be calculated accurately by the first of the above methods unless the rotation of the heater is taken into consideration. In other words, this method is not reliable unless the time when the driving system stops is also taken into account. This, however, complicates the calculation excessively and the method becomes impractical.

The second of the methods described above is more advantageous because the reference temperature may be set lower than the surface temperature of the heat roller required for its operation and the heater abnormality can be detected more quickly. This method, however, suffers the same problem described above because the driving motor of the system may or may not be operating and hence the heat roller may or may not be rotating during the warmup period of the apparatus and the reference time period must be selected accordingly. In other words, the reference time period must be selected as the time required for the heat roller to reach the specified temperature level when its temperature is rising at a lower rate and this means that it takes longer to conclude whether an abnormality exists or not.

SUMMARY OF THE INVENTION

It is therefore an object of the present invention to provide a simple method of quickly and accurately detecting an abnormal temperature condition of a heat roller without the need for a complicated calculation to determine the time at which the condition should be examined.

The above and other objects of the present invention are accomplished by improving the second of the methods described above such that the time at which the temperature condition of the heater is examined is corrected according to the length of time during which the roller has rotated since the heating of the roller was started.

According to the method of the present invention, the length of time during which the roller has rotated since the beginning of the heating operation is taken into account and the time at which the temperature condition of the heat roller is examined is corrected according to the length of this time. If the roller is rotated, the rate of its heat emission increases and hence the rate of its temperature increase diminishes as compared to when it remains stationary. In other words, the longer the period during which the heat roller has rotated, the longer becomes the time required for it to reach a specified reference temperature. According to the present invention, therefore, the time at which the condition of the heat roller is examined is adjusted according to the length of time during which the roller has rotated such that the examination can be effected more reliably. In addition, the method of the present invention is advantageous in that the time required for detection of an abnormal condition can be shortened compared to the second method described above whereby the time of examination is set under the assumption that the roller has been rotating all the time.

BRIEF DESCRIPTION OF THE DRAWINGS

The accompanying drawings, which are incorporated in and form a part of the specification, illustrate an embodiment of the present invention and, together with the description, serve to explain the present invention. In the drawings.

DETAILED DESCRIPTION OF THE INVENTION

Figure 1A:
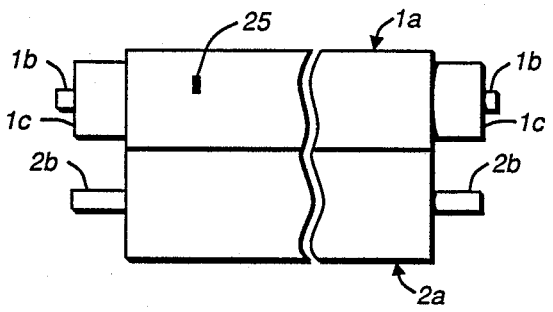
FIGS. 1A and 1B are respectively a schematic plan view and a sectional view of a fixing device which uses a method of the present invention.
Figure 1B:
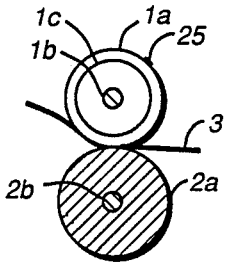

As shown in FIGS. 1A and 1B, a fixing device adapted to use a method of the present invention includes a heat roller (or an upper roller) and a fixing roller (or a lower roller) which are supported axially by side frames (not shown) and a means for peeling off a copy paper sheet. The heat roller is hollow and cylindrical and its housing structure **1*a* envelopes a heater 1*b* which heats the heat roller housing structure 1*a*. The fixing roller comprises a main structure 2*a* and a rotary shaft 2*b*. The heat roller housing structure is also provided with a shaft 1*c*. These shafts 1*c* and 2*b* are supported by supporting members (not shown) on the aforementioned frames such that the heat roller housing structure 1*a* is pressed against the fixing roller main structure 2*a*. A temperature sensor 25 for detecting the surface temperature of the heat roller is disposed in contact with the surface of the heat roller housing structure 1*a*. The heat roller shaft 1*c* is connected on one side to a driving means (not shown) for causing the heat roller housing structure 1***a* to rotate.

Figure 2:
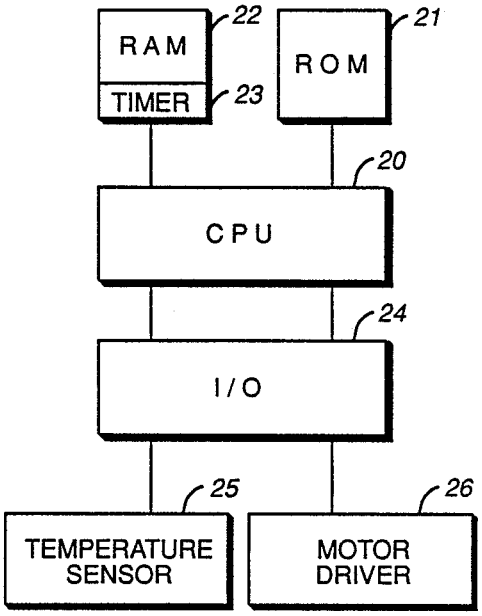
FIG. 2 is a block diagram of a portion of a control unit which uses the method of the present invention.

The control unit of the apparatus of which the fixing device shown in FIGS. 1A and 1B is a part includes, as shown in FIG. 2, a central processing unit CPU 20 for controlling the entire operation of the apparatus, a read-only memory ROM 21 storing its control program, and a random-access memory RAM 22 to which are assigned a timer 23, working areas and the like. Input signals from a power switch (not shown) and a print key (not shown) as well as detection signals from the temperature sensor 25 are received by the CPU 20 through an interface circuit I/O 24. During a warmup period after the power switch is pressed or during a printing operation after the print switch is pressed, a drive signal is outputted from the CPU 20 through the interface circuit I/O 24 to a motor driving circuit 26.

Figure 3:
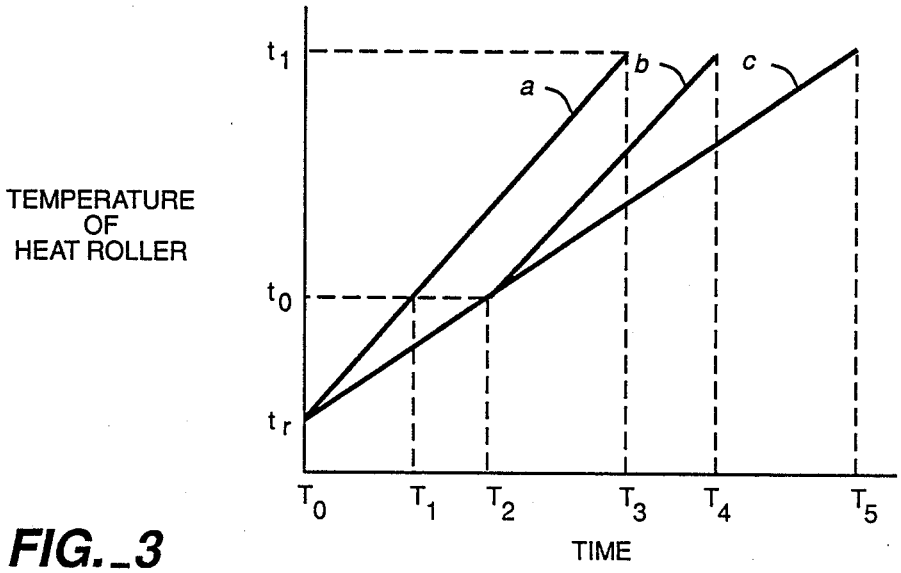
FIG. 3 is a graph showing the change in the temperature of a heat roller with time.

In FIG. 3, the straightline a indicates the change in the surface temperature of the heat roller from its initial room temperature value $t_r$ when the roller is not rotating, the straight line c indicates the change in the surface temperature of the heat roller when the roller is rotated, and the curve b shows the change in the surface temperature of the heat roller when the heat roller is rotated until time $T_2$ and then stopped. The temperature level $t_1$ indicates a predetermined reference temperature of the heat roller and the time $T_3$ indicates the time required for the roller surface temperature to reach $t_1$ while the heat roller remains stationary. The slope of the curve a is known and is preliminarily stored in a memory. The time $T_2$ represents the time at which the rotation of the heat roller stops and $t_0$ represents its surface temperature at that time. The time $T_1$ represents the time at which the temperature $t_0$ is reached if the heat roller is not rotated. The time $T_4$ represents the time when the surface temperature of the heat roller reaches $t_1$ if the heat roller is operated under the conditions of the curve b. The time $T_5$ represents the time when the surface temperature of the heat roller reaches $t_1$ if the heat roller keeps rotating.

When power is switched on the copier, not only does the heater 1*b* begin to heat up but also the copier motor is activated and the heat roller begins to rotate, thereby reducing the rate of increase of its surface temperature from the value if it remains stationary. The heat roller continues to rotate until $T_2$ when the stirring of toner inside the developer unit is stopped. At this moment, the surface temperature $t_0$ of the heat roller is detected and the time $T_1$ at which the same temperature $t_0$ would be reached if the heat roller had been stationary is obtained. The difference between $T_1$ and $T_2$ is calculated and the correction according to the present invention is effected by adding this difference to $T_3$ to obtain $T_4$. The surface temperature of the heat roller is measured at $T_4$ and if this measured temperature is greater than $t_1$ (which would be reached at $T_3$ if the heat roller did not rotate), it is concluded that there is no abnormality in the heat roller. If this measured temperature is less than $t_1$, it is concluded that an abnormality exists.

In summary, a time correction represented by the difference $T_2$-$T_1$ is obtained according to the length of time during which the heat roller is rotated from the beginning of its heating operation and this difference is added to the present time $T_3$ to correct the time of measurement. According to the second of the prior art methods described above, the measurement of the surface temperature of the heat roller would be taken at $T_5$ to determine the existence of an abnormal condition. Thus, the present invention can shorten the time required for the detection of an abnormal condition by $T_5$-$T_4$.

Figure 4:
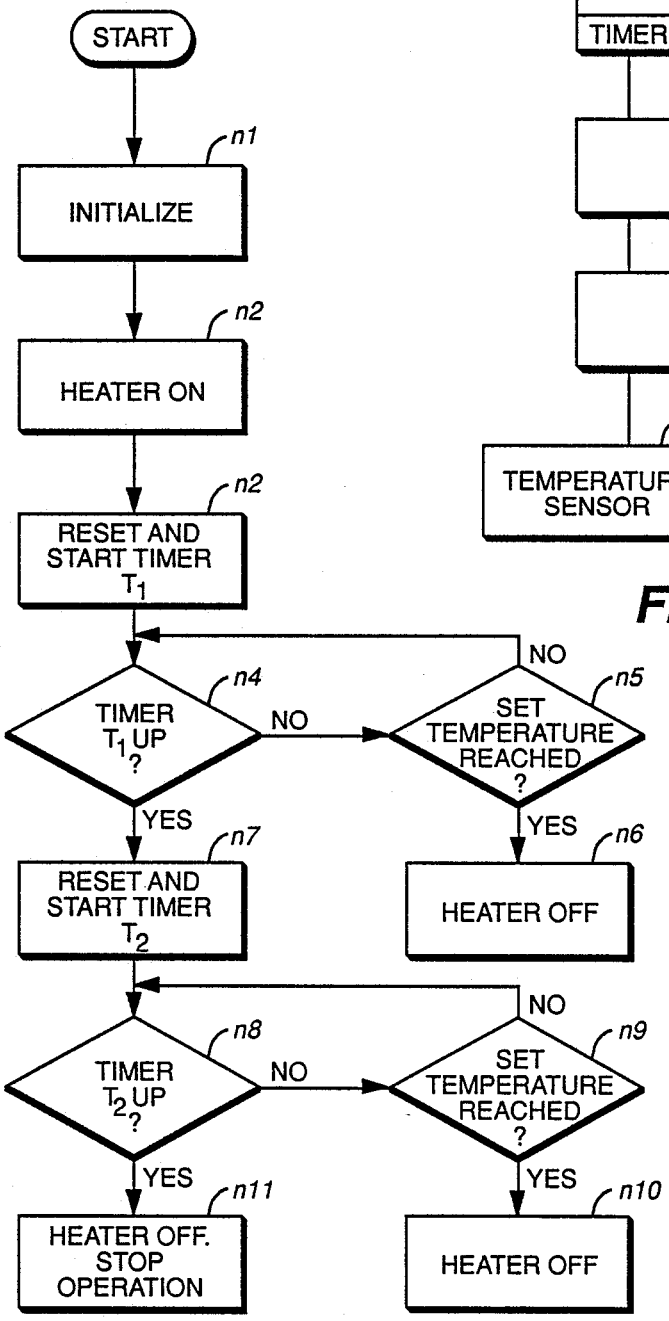
FIG. 4 is a flow chart showing the operation of the control unit of FIG. 2.

The operation of the CPU 20 for detecting an abnormal condition of the heat roller is explained next by way of the flow chart shown in FIG. 4. After an initialization routine is carried out (n1) when power is switched on, the heater 1*b* is switched on (n2) and a timer T1 is reset and started. The timer T1 is for counting up the aforementioned time period of T3 explained by way of FIG. 3. The surface temperature of the heat roller is constantly monitored and if it reaches the preset value $t_1$ before the timer T1 counts up the time period of $T_3$ (YES in n5), it is concluded that the heat roller is functioning normally and the heater 1*b* is switched off and another temperature control routine (not shown in FIG. 4) is started. If the timer T1 counts up the time period of T3 before the surface temperature of the heat roller reaches $t_1$, it is concluded that the characteristic curve b of FIG. 3 is being followed and another timer T2 is reset and started (n7) to count up the time period of $T_2$-$T_1$ representing the aforementioned correction. It should be noted that this time period set for the timer T2 is not a constant because it depends on the length of time during which the heat roller is rotated. The surface temperature of the heat roller is again constantly monitored and if it reaches $t_1$ before the timer T2 counts up the set time (YES in n9), it is concluded that the heat roller is functioning normally and the heater 1*b* is switched off (n10) and another temperature control routine is started as after Step n6. If the timer T2 counts up the aforementioned set time period before the surface temperature of the heat roller reaches $t_1$ (YES in n8), on the other hand, it is concluded that an abnormal condition exists in the heat roller and the heater 1*b* is switched off and the entire operation of the copier is stopped (n11).

In summary, the method of the present invention is characterized as changing the time of examining the condition of the heat roller according to the length of time during which the heat roller has rotated. Thus, the determination of the condition can be effected easily without involving any complicated calculations and the time required for the examination can be reduced.

The foregoing description of a preferred embodiment of the invention has been presented for purposes of illustration and description. It is not intended to be exhaustive or to limit the invention to the precise form disclosed and many modifications and variations are possible in light of the above teaching. Any such modifications and variations that may be apparent to a person skilled in the art are intended to be within the scope of the present invention.

What is claimed is:

1. A method of detecting an abnormality in a rotatable heat roller comprising the steps of starting to heat and rotate said heat roller at a starting time, monitoring the surface temperature of said heat roller, concluding that said heat roller is functioning normally if the surface temperature of said heat roller reaches a preset temperature level $t_1$ before a critical time interval $T_3+T_2-T_1$ passes from said starting time, where $T_3$ is indicative of a time length required for the surface temperature of said heat roller to reach said temperature level $t_1$ if said heat roller remains stationary, $T_2$ is indicative of another time length after which the rotation of said heat roller is stopped and $T_1$ is indicative of still another time interval required for the surface temperature of said heat roller to reach an intermediate temperature level $t_0$ if said heat roller remains stationary, said intermediate temperature level $t_0$ being indicative of the surface temperature level to be reached by said heat roller in time interval $T_2$ if said heat roller continues to rotate, and concluding that said heat roller is functioning abnormally if said critical time interval $T_3+T_2-T_1$ passes from said starting time before the surface temperature of said heat roller reaches said temperature level $t_1$.

2. The method of claim 1 further comprising the step of counting said time interval of $T_3$ from said starting time.

3. The method of claim 2 further comprising the step of thereafter counting time interval of $(T_2-T_1)$.

* * * * *